US007137338B2

(12) United States Patent
Brandenburg et al.

(10) Patent No.: US 7,137,338 B2
(45) Date of Patent: Nov. 21, 2006

(54) METHOD AND APPARATUS FOR CONTROLLING THE WEB TENSION AND THE CUT REGISTER OF A WEB-FED ROTARY PRESS

(75) Inventors: Günther Brandenburg, Gröbenzell (DE); Stefan Geissenberger, Augsburg (DE); Andreas Klemm, Bad Wörishofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 209 days.

(21) Appl. No.: 10/912,842

(22) Filed: Aug. 6, 2004

(65) Prior Publication Data

US 2005/0061189 A1 Mar. 24, 2005

(30) Foreign Application Priority Data

Aug. 6, 2003 (DE) ..... 103 35 887

(51) Int. Cl.
*B41F 1/54* (2006.01)

(52) U.S. Cl. ..... 101/484; 101/485; 101/219

(58) Field of Classification Search ..... 101/483–485, 101/211, 171, 217–219, 224–228, 247, 248
See application file for complete search history.

(56) References Cited

U.S. PATENT DOCUMENTS

| | | | | |
|---|---|---|---|---|
| 6,092,466 | A * | 7/2000 | Koch et al. | 101/485 |
| 6,766,737 | B1 * | 7/2004 | Glockner et al. | 101/228 |
| 6,810,812 | B1 * | 11/2004 | Fischer | 101/485 |
| 6,837,159 | B1 * | 1/2005 | Elkotbi et al. | 101/219 |
| 7,032,518 | B1 * | 4/2006 | Scheffer et al. | 101/485 |

FOREIGN PATENT DOCUMENTS

DE G 85 01 065.0 6/1985

* cited by examiner

*Primary Examiner*—Minh Chau
(74) *Attorney, Agent, or Firm*—Cohen, Pontani, Lieberman & Pavane

(57) ABSTRACT

To control the cut register of a web in a web-fed rotary press and to control the web tension decoupled from the control of the cut register, a specific item of image information or measuring marks of the printed web are registered by at least one sensor and the web tension is registered by at least one further sensor. The deviation of the position of the printed image with respect to its intended position, based on the location and time of the cut, is determined from the item of image information and is therefore available as actual values and supplied to a control device. The cut register error and the web tension can be influenced in a manner decoupled from each other.

38 Claims, 12 Drawing Sheets

METHOD AND APPARATUS FOR CONTROLLING THE WEB TENSION AND THE CUT REGISTER OF A WEB-FED ROTARY PRESS

BACKGROUND OF THE INVENTION

1. Field of the Invention

The invention relates to a method and an apparatus for controlling the web tension and the cut register of a web-fed rotary press.

2. Description of the Related Art

In web-fed rotary presses, it is known to use an actuating roll which can be moved in linear guides as an actuating element for correcting errors in the position of the cutting register on a web. In this case, the actuating roll changes the paper path length between two draw units to correct the cutting register error. Register rolls of this type are shown, for example, in DE 85 01 065 U1. The adjustment is generally carried out by an electric stepping motor. However, apparatuses of this type are afflicted with a relatively high mechanical and electrical complexity.

SUMMARY OF THE INVENTION

It is an object of the invention to provide an accurate method of controlling the cutting register error and the web tension in a web-fed rotary press.

In the following specification and claims, the term 'clamping point' refers to a nip through which the web runs in the web-fed rotary press such as, for example, in a printing unit, cooling unit, turner unit or knife cylinder unit. The 'cutting register error' is the deviation of the cutting register from its intended position, the 'total cutting register error' is the deviation of the cutting register, at the time of cutting by the knife cylinder, from its intended position, and the 'partial cutting register error' is the deviation of the cutting register from its intended position at a clamping point prior to or upstream of the knife cylinder. The intended position being a position at a specific time of measurement relative to when the cutting register was printed by the printing clamping point or was registered at a previous clamping point.

According to the present invention, the total cutting register error and/or partial cutting register error and the web tension are in the same or in different sections of the press and are controlled simultaneously. Furthermore, the control of the cutting register error is decoupled from the control of the web tension in the control sense such that the two variables are predefined independently of each other.

According to the present invention, the running time of the web image points on a web is adjusted for controlling the cutting register in a constant web path. In contrast, the prior art changes the web length of the web while maintaining a constant web speed. The method according to the present invention also changes the lead (speed) of a non-printing clamping point. Both the adjustment of the running time and the adjustment of the speed of a non-printing clamping point ensure stable overall control as a result of decoupling measures. Hitherto, this was not possible in the prior art.

According to the present invention, a specific item of image information or measuring marks of the printed web are registered by at least a first sensor to control the cutting register error and the web tension is registered by at least a second sensor, the registrations of the first and second sensors being and supplied to a control device. More specifically, a partial cutting register error $Y_{1i}$* to be controlled is measured at or before a clamping point i, and a web tension $F_{k-1,k}$ or $F_{i-1,i}$ to be controlled is measured at or before another clamping point k or the same clamping point i, the clamping points being non-printing and in each case being located before the knife cylinder (clamping point 4). The controlled variables, i.e., the web tension $F_{k-1,k}$ or $F_{i-1,i}$ and the part cut register error $Y_{1i}$*, are set by means of suitable manipulated variables $v_{i-1,i}$, $v_i$, $v_{k-1,k}$, $v_k$ and associated controllers in accordance with corresponding set points $Y_{1iw}$*, $F_{k-1,k,w}$, $F_{t-1,i,w}$, so that the web tension assumes its set point, which lies in a prescribed range, and the part cut register is corrected to the set point, for example the value zero Furthermore, the associated controllers are decoupled from one another in the control sense.

Sensors are preferably used for the determination of the controlled variables. Alternatively, models may also partly or completely replace these sensors, wherein the variables are estimated in an equivalent manner with the aid of mathematical or empirical models.

The manipulated variable for the cutting register error may be the lead of a non-printing clamping point and the manipulated variable for the web tension may be the lead or position of the printing units, both controls being implemented by appropriate control loops. The normal drive controls for current, rotational speed and/or angle control of the manipulated variables are subordinated to the control loops.

In an alternative embodiment, the manipulated variable of the cutting register is the speed $v_k$ of a clamping point k and the manipulated variable for the web tension is the speed $v_i$ of a clamping point i. In this alternative embodiment, the force $F_{i,i+1}$ in the following web section must not change in a self-compensating manner the event of a change in the speed $v_i$ of this clamping point. This is the case if, in the preceding web sections, moisture and/or heat is put into the web. In particular, the lead of a cooling unit in a web-fed press may be used for this purpose.

The force exerted on the web by the dancer roll force can also be selected as the manipulated variable for the web tension, this being determined from the pressure of the associated pneumatic cylinder, supplied to a web tension controller and compared with the force set point, the output variable from the controller either directly being the manipulated variable for the pneumatic cylinder or the set point $F_{01w}$ if there is a subordinate control loop for the input web tension $F_{01}$. This force adaptation ensures that a force change to the register error occurring quickly as a result of a fault being controlled out is dissipated relatively slowly with respect to this control.

According to the present invention, additional decoupling lead set points are applied only to all the clamping points located before the clamping point controlling the cutting register error, for example the turner unit (reverse decoupling). This reverse decoupling is imperative for stable operation. Alternatively, or in addition, all the clamping points located after the clamping point controlling the register error, for example the turner unit, receive additional decoupling lead set points.

For the partial decoupling in the reverse direction, the predefinition of the additional decoupling lead set point for the clamping point 2 is effected by an additional rotational speed set point and for the clamping point 1 in the form of a corresponding additional tension set point at the input of the tension controller via an appropriately modified transfer function of the closed tension control loop. Alternatively, the predefinition of the additional decoupling lead set point for the clamping point 1 is effected by an appropriate additional rotational speed set point via balancing filters. In addition, for the purpose of decoupling in the forward direction via a transfer function $F_x$, feedforward control of the clamping point 3 may be effected by either an appropriate additional register set point at the input of the cutting register controller, a further transfer function, or a balancing filter on the subordinate rotational speed control loop of the cutting register control loop.

It should be emphasized that the association between controlled variables and manipulated variables, including all the corresponding decoupling and feedforward control measures needed for this configuration, may be interchanged.

The cut register error may be measured immediately before the knife cylinder and may be controlled by a register controller which is superimposed on the cutting register controller of the clamping point 3.

The method according to the present invention requires no additional mechanical web guide elements to be added to a rotary press. For correcting a cutting register error, existing non-printing draw units such as, for example, a cooling unit, pull rolls in the folder superstructure, s former roll or further draw units located in the web course between the last printing unit and knife cylinder, are used. The existing non-printing drawing units are preferably driven by individual variable-speed drives.

The parameters entering the cutting register error control section are largely independent of the properties of the rotary press. Furthermore, the accuracy of the cutting register error is increased substantially by the new method according to the present invention.

The invention also relates to an apparatus for implementing the method for controlling the cutting register error in a rotary press having clamping points 1 to 4 which can be driven independently of one another by drive motors with associated current, rotational speed and, if appropriate, angle control. The cutting register error and/or further partial cutting register deviations $Y_{13}$*, $Y_{1i}$*, $Y_{ik}$* associated with the cutting register error at or before a knife cylinder and/or at or before clamping points i, k, 1 to 3 arranged before one or more of these knife cylinders (clamping point 4) can be registered via a specific item of image information or measuring marks on the printed web by at least a first sensor. The web tension can be registered by at least a second sensor. The data determined by the sensors for influencing the cut register error $y_{14}$ is supplied to a closed-loop and/or open-loop control device for changing angular positions or circumferential speeds $\nu_i$ to $\nu_3$, $\nu_i$, $\nu_k$ of the respective clamping point $K_i$, $K_k$, $K_1$ to $K_3$.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1A:
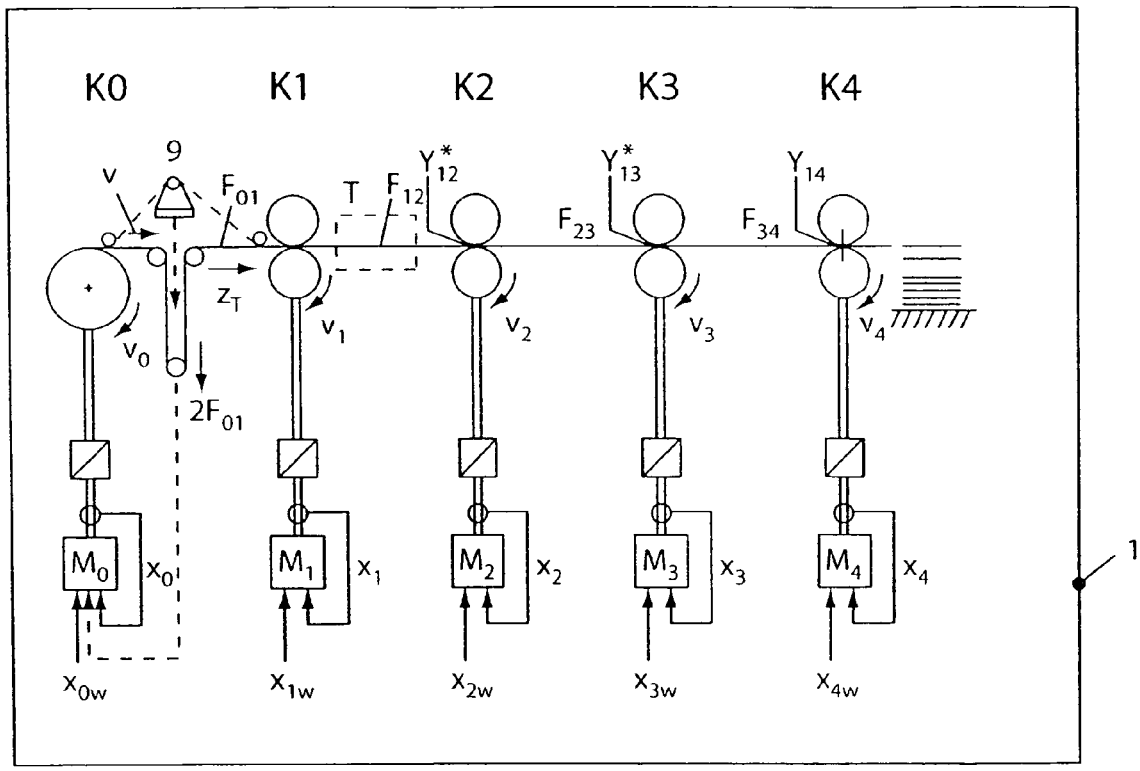
FIG. 1*a* is a schematic diagram of the clamping points of a rotary press with controlled drives.

The method and apparatus according to the present invention will be explained in the following functional description with reference to a four-roll system according to FIG. 1*a*. In the actual press in which the invention is implemented may differ according to specific requirements of a particular application For example, instead of one clamping point 1 ($K_1$) of the four-roll system, as many printing units as desired, that is to say for example four printing units of a web-fed offset illustration press or newspaper press or another type of rotary presses, may be present. The principle described in the following text using the example of an illustration press of the register and web tension control by two mutually decoupled control loops can be transferred with the same effect to all rotary presses.

Controlling the Register Error at a Non-Printing Clamping Point Before the Knife Cylinder 1. Functional Explanation of the Four-Roll System The four roll system of FIG. 1*a* is a simplified form of a rotary press, in particular a web-fed offset press. All the printing units are represented in one clamping point 1 ($K_1$) following the unwind which is represented by clamping point 0 ($K_0$). Between clamping points 0 ($K_0$) and 1 ($K_1$), FIG. 1*a* depicts a dancer roll or tension control loop for predefining the web tension $F_{01}$. The dancer roll or tension control loop is an abbreviated representation of a device for setting the web tensions after the unwind ($K_0$) and in the threading mechanism. In the example of an illustration press, clamping point 2 ($K_2$) represents a cooling unit, clamping point 3 ($K_3$) represents a turner unit and clamping point 4 ($K_4$) represents a folding unit with the knife cylinder for determining the cut. As shown in FIG. 1*a*, a dryer T, may be arranged between clamping units 1 ($K_1$) and 2 ($K_2$). The variables $v_i$ are the circumferential speeds of the clamping points ($K_i$), which are approximated by the behavior of wrapped rolls with Coulomb friction. In the case of rotary presses, instead of the term "speed", the term "lead" is used. The lead $W_{i,i-1}$ of a clamping point i ($K_i$) with respect to a clamping point i–1 ($K_{i-1}$) is given by the expression $$W_{i,i-1} = \frac{v_i - v_{i-1}}{v_{i-1}}.$$

In the following text, "speed" and "lead" will be used synonymously. The web tension force in a section i–1, i will be designated $F_{i-1,i}$. The changes in the modulus of elasticity and in the cross section of the web running in will be combined into $Z_r$. The register error $Y_{14}$ on the knife cylinder is designated the total cutting register error or, in brief, the cutting register error. A register error $Y_{1i}$* which has run out previously, measured at a non-printing clamping point i, will be designated the partial cutting register error, in brief, partial register error.

Figure 1B:
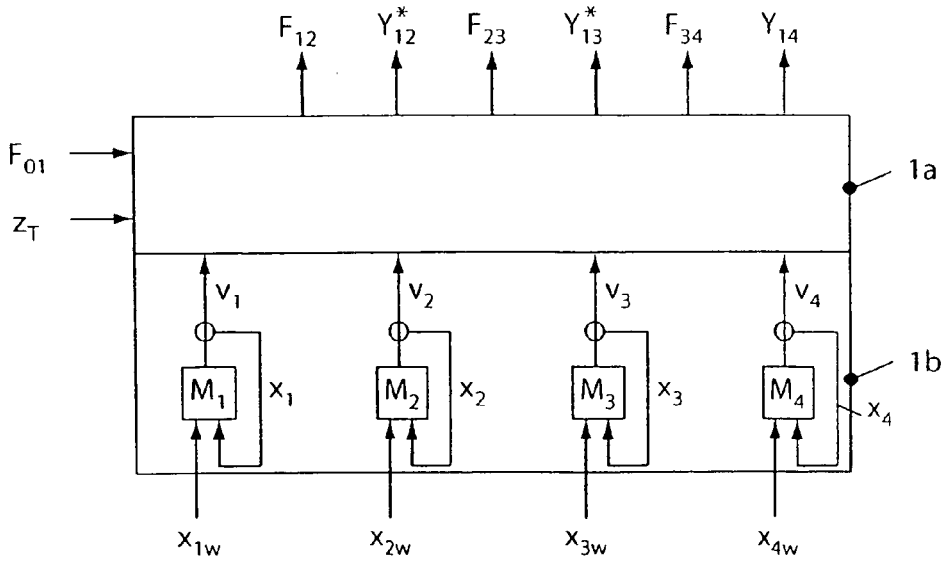
FIG. 1*b* is a schematic diagram showing the controlled drives of FIG. 1*a* with a mechanical system.
Figure 2:
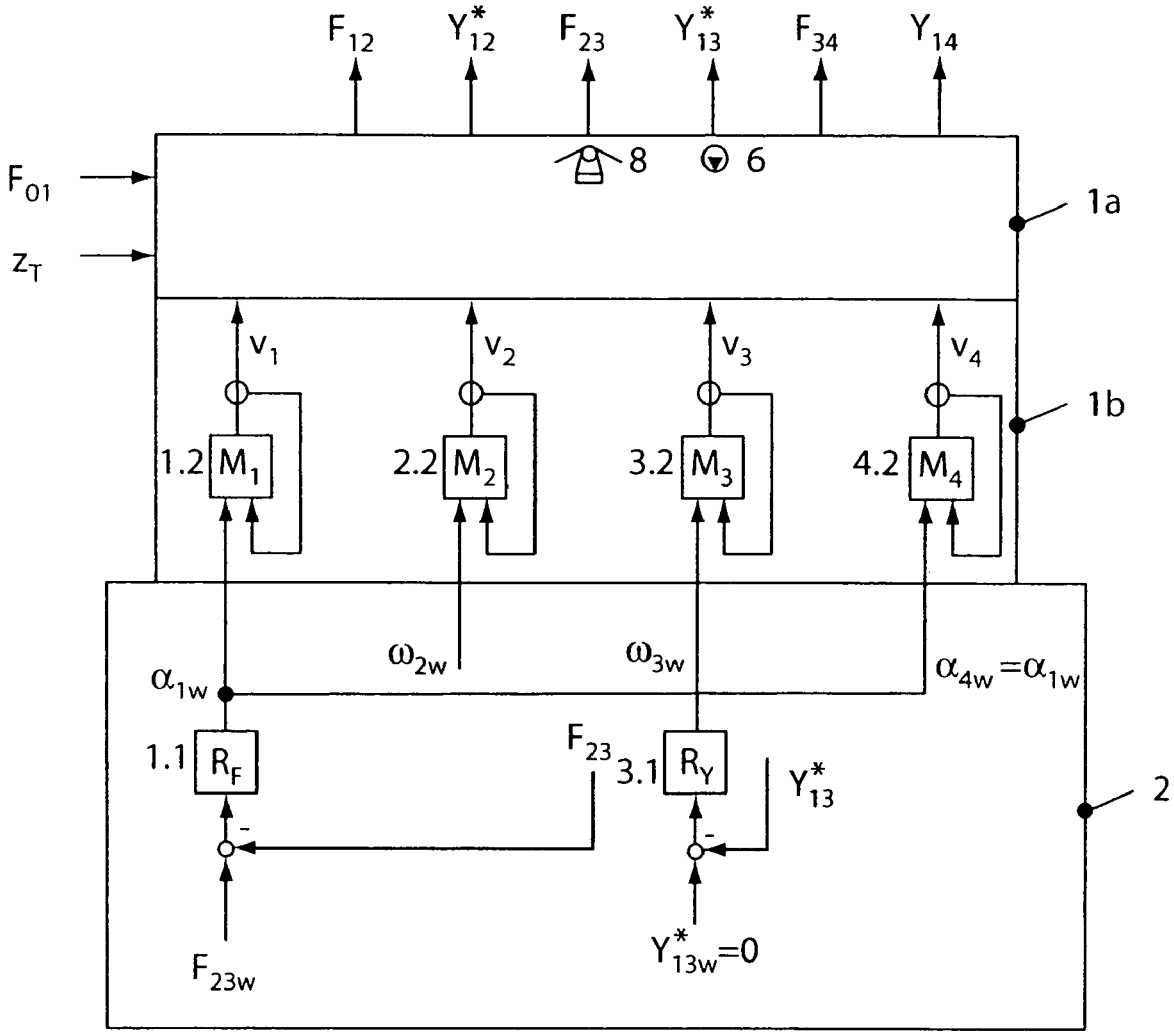
FIG. 2 is a schematic diagram showing an arrangement for controlling the cut register and the web tension of a rotary press.

The system I of FIG. 1*a* is shown schematically in FIG. 1*b* as including a mechanical controlled system 1*a* with associated actuating elements, i.e., controlled drives, in block 1*b*. FIG. 2 shows that the two controlled variables are the partial cutting register error $Y_{13}$*, as equivalent variable to the total cut register error $Y_{14}$, and the web tension $F_{23}$. The manipulated variables for controlling the controlled variables are the lead of the clamping point 3 ($K_3$) and the lead or position of the clamping point 1. Using appropriate control loops, the controlled variables are predefined independently of each other in accordance with set points. The partial cutting register error $Y_{13}$* is the deviation of a fixed image reference point, for example the edge of the image, at the clamping point 3 ($K_3$), as compared with the position of this point at the clamping point 1 ($K_1$), from its intended position. The cut register error $Y_{14}$ is the error of the cut edge at the clamping point 4 ($K_4$) in relation to the cutting time as compared with its position at the clamping point 1 ($K_1$), from its intended position.

The actuating elements are formed by the controlled drive motors $M_1$ to $M_4$. The input variables $x_{iw}$ illustrated in FIG. 1*a* and FIG. 1*b* represent the angular velocity (rotational speed) or angle set points of the controlled drives $M_1$ to $M_4$.

The non-steady or steady mass flow supplied to the system via the input of the clamping point 1 ($K_1$), measured in $kgs^{-1}$, is determined by the circumferential speed $v_1$ of the clamping point 1 ($K_1$) and the extension $\epsilon_{01}$. In the case of Hookean materials, the force $F_{01}$ is proportional to the extension $\epsilon_{01}$. The web tension force $F_{01}$ on the web running through the rotary press may be set by controlling the pressing force of a dancer roll or a self-aligning roll on the web, or by a tension control loop which—in accordance with the position set point or force set point—controls the circumferential speed of the clamping point 0 (unwind) directly or indirectly via a further device for setting the web tension. Only the circumferential speed of the unwind is capable of changing the mass flow introduced into the system in a steady manner. In the following text, it will be assumed that changes of $F_{01}$ or of $v_1$ change the unsteady or steady mass flow in the web sections following them because of the change effected thereby in the circumferential speed of the unwind. The circumferential speeds of the remaining clamping points cannot change the mass flow in a steady manner assuming Hookean material. The circumferential speeds will be referred to in brief as speeds in the following text.

2. Register Control Loop

The partial cutting register error $Y_{13}$*, as FIG. 2 shows, is controlled to the predefined set point $Y_{13w}$* which may, for example, be $Y_{13w}$*=0, by the register controller 3.1 by manipulating the speed $v_3$ of the clamping point 3 ($K_3$) (which is a turner unit in the illustrative example). The rotational speed control loop 3.2 of the drive motor $M_3$ assigned to the clamping point 3 ($K_3$) is subordinate to the register control loop. The very small equivalent time constant of the current control loop subordinate to the rotational speed control loop is negligible.

3. Tension Control Loop

Since the register control is connected to a change in the web tension $F_{23}$ via the lead of the clamping point 3 ($K_3$), it is not possible to rule out the situation where large disturbances cause excessively small or excessively high web tensions, which may cause a web break. The web tension $F_{23}$ must therefore be limited. For this purpose, web tension $F_{23}$ is measured with a tension sensor 8 such as, for example, a measuring roll and supplied to the comparison point of a tension controller 1.1 where web tension $F_{23}$ is compared with the set point $F_{23w}$ (see FIG. 2). The tension control 1.1 ensures compliance with the desired web tension set point $F_{23w}$ and, at the same time, ensures that set point $F_{23w}$ can be predefined in a paper grade-dependent manner by the machine operator, who no longer has to intervene in setting the lead of the clamping point 3 ($K_3$). The tension controller 1.1 predefines the angle set point $\alpha_{1w}$ for the virtual line shaft, that is to say the common set point for the angle control loops of all the printing units and of the knife cylinder ($K_4$). Each angle control loop comprises an angle controller and the subordinate rotational speed control loop including a current control loop (combined in the block 1.2).

4. Coupling Between the Controlled Variables

The two controlled variables, namely the part register error $Y_{13}$* and the tension $F_{23}$, depend on each other, that is to say they are coupled to each other, by the structure of the control system. If, for example, a change to the value of set point $F_{23w}$ is made, then the action of the tension controller 1.1 is bound up with a change in the position of the printing units and causes a partial cutting register error $Y_{13}$*. In response, the register control loop controller 3.1 now attempts to lead this error $Y_{13}$* back to the set point $Y_{13,w}$* again, for example value 0, by changing a speed $v_{31}$ as a result of which, however, the force $F_{23}$ is changed. Thus the tension control loop responds again, and so on. The entire system of FIG. 2 can therefore become unstable.

5. Principle of Decoupling

The principle of decoupling will be explained by using FIG. 3. Without any decoupling measure, the part register error $Y_{13}$* and the tension $F_{23}$ depend on both manipulated variables, namely the speed changes $v_1$ and $v_3$. The objective is to make $Y_{13*}$ dependent solely on $v_3$ and $F_{23}$ dependent solely on $v_1$.

5.1 Decoupling Method I (Partial Decoupling)

The first measure is to add the speed $v_3$ to $v_2$, that is to say to communicate each movement of the clamping point 3 ($K_3$) to the clamping point 2 ($K_2$) as well. This leads to the situation where the correction of $Y_{13}$* with the aid of $v_3$ no longer leads to a change in $F_{23}$, that is to say $Y_{13}$* no longer depends on $F_{23}$. However, $v_3$ then also influences $F_{12}$. The second measure therefore consists in adding the speed $v_3$ to $v_1$ as well. As a result, the reaction of $v_3$ on $F_{12}$ is suppressed. The clamping points 1 ($K_1$) and 2 ($K_2$) therefore carry out the same movement as the clamping point 3 ($K_3$). Therefore, $F_{23}$ is only influenced by $v_1$. The method already operates in a stable manner with this partial decoupling.

5.2 Decoupling Method II (Complete Decoupling)

In decoupling method I, the partial cutting register error $Y_{13}$* always depends on $v_1$. However, $v_3$ is the desired control variable of the partial cutting register error $Y_{13}$*. This dependency is eliminated by $v_1$ being managed via the transfer function $F_x$, which can be calculated, and its output signal x being subtracted from $v_3$. That is, the transfer function $F_x$ defines a desired difference between speeds $v_1$ and $v_3$. This feedforward control is also performed in for the speed $v_4$ and can optionally also be performed for the speed $v_2$ as well (illustrated by dashed lines in FIG. 3). Then, $Y_{13}$* depends solely on $v_3$. Therefore, the control objective formulated above has been reached. This method also operates in a stable manner in the form described.

6. Implementation of the Decoupling

Figure 3:
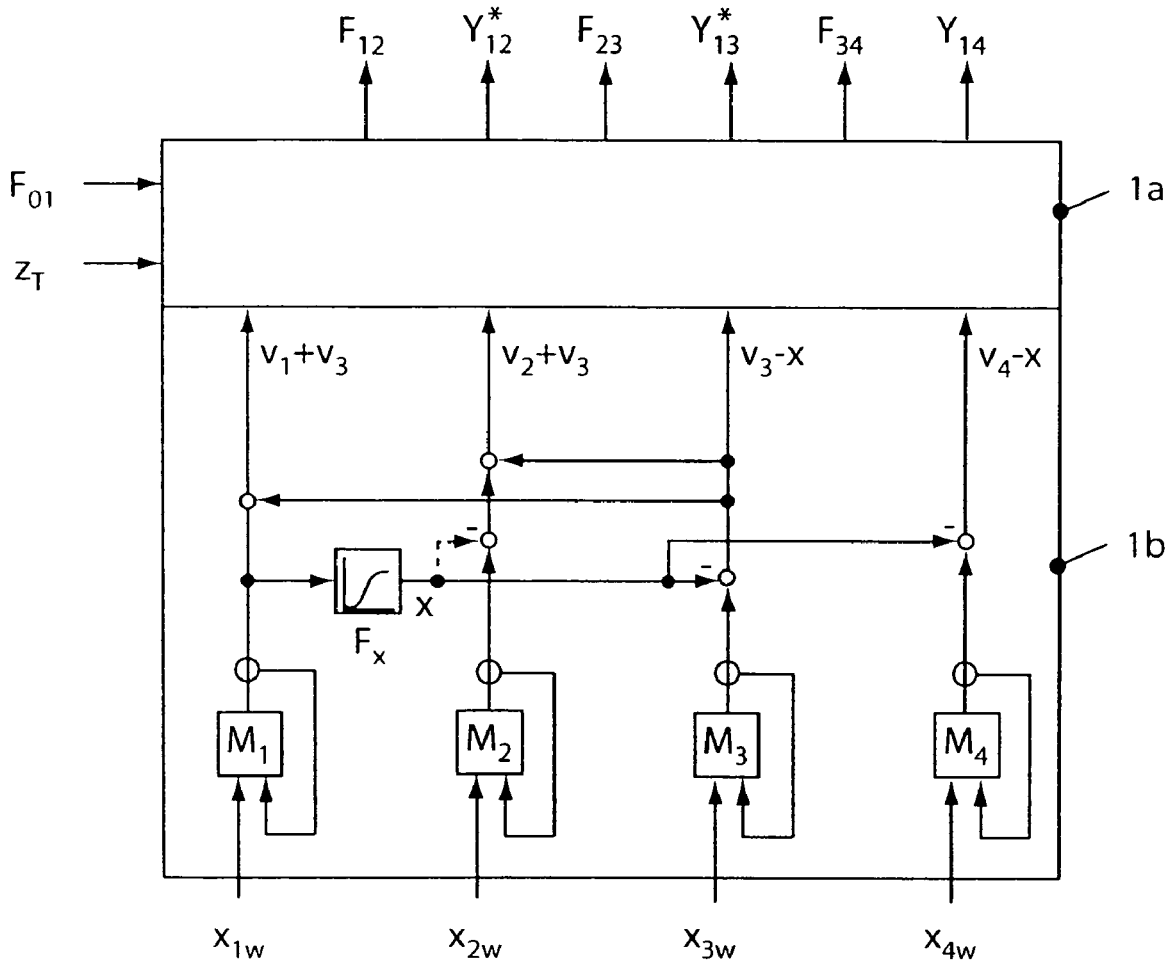
FIG. 3 is a schematic diagram showing complete decoupling of the controlled variables at the mechanical level.
Figure 4:
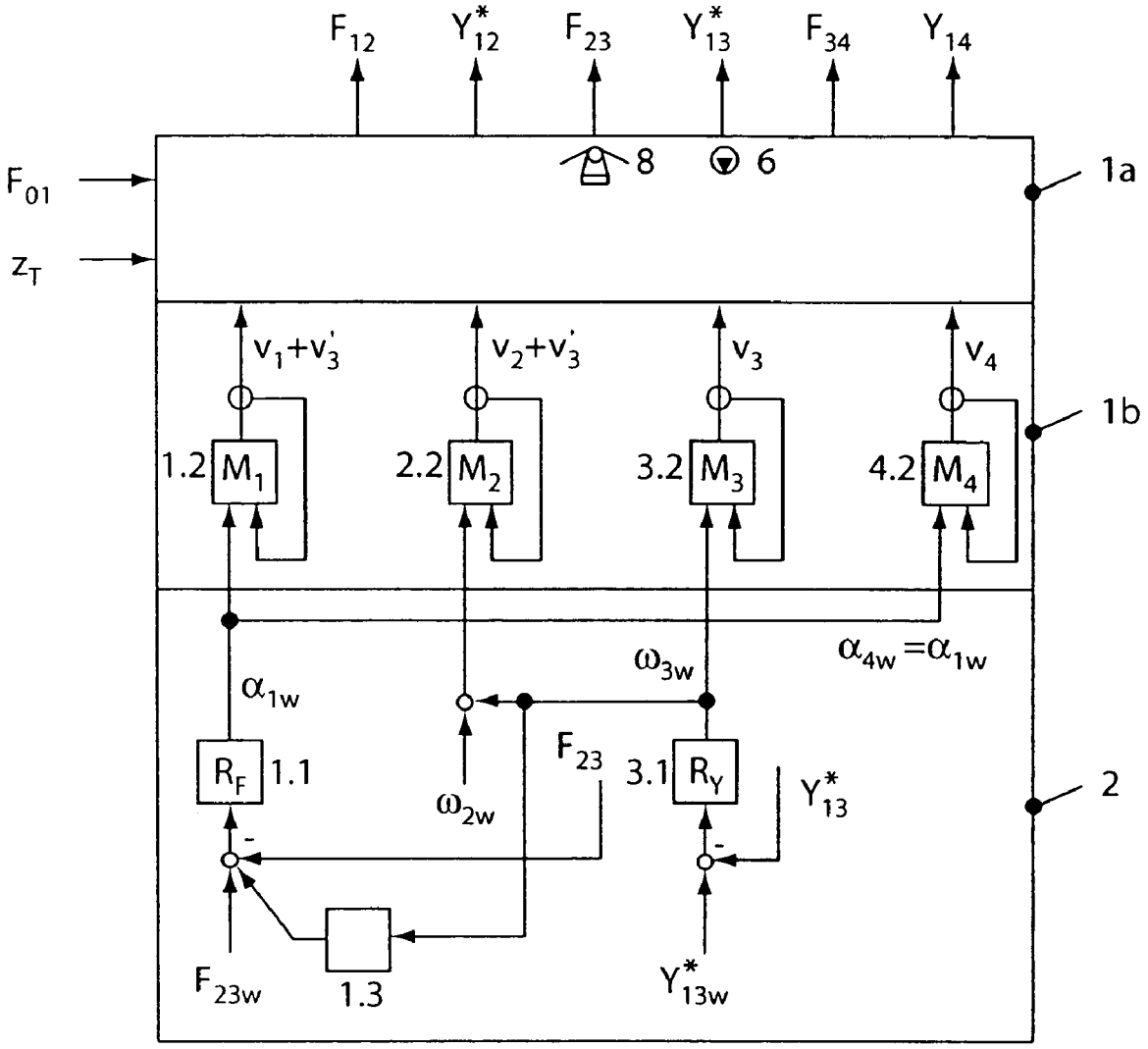
FIG. 4 is a schematic diagram showing partial decoupling of the controlled variables at the electronic level by an additional set point for the web tension.
Figure 5:
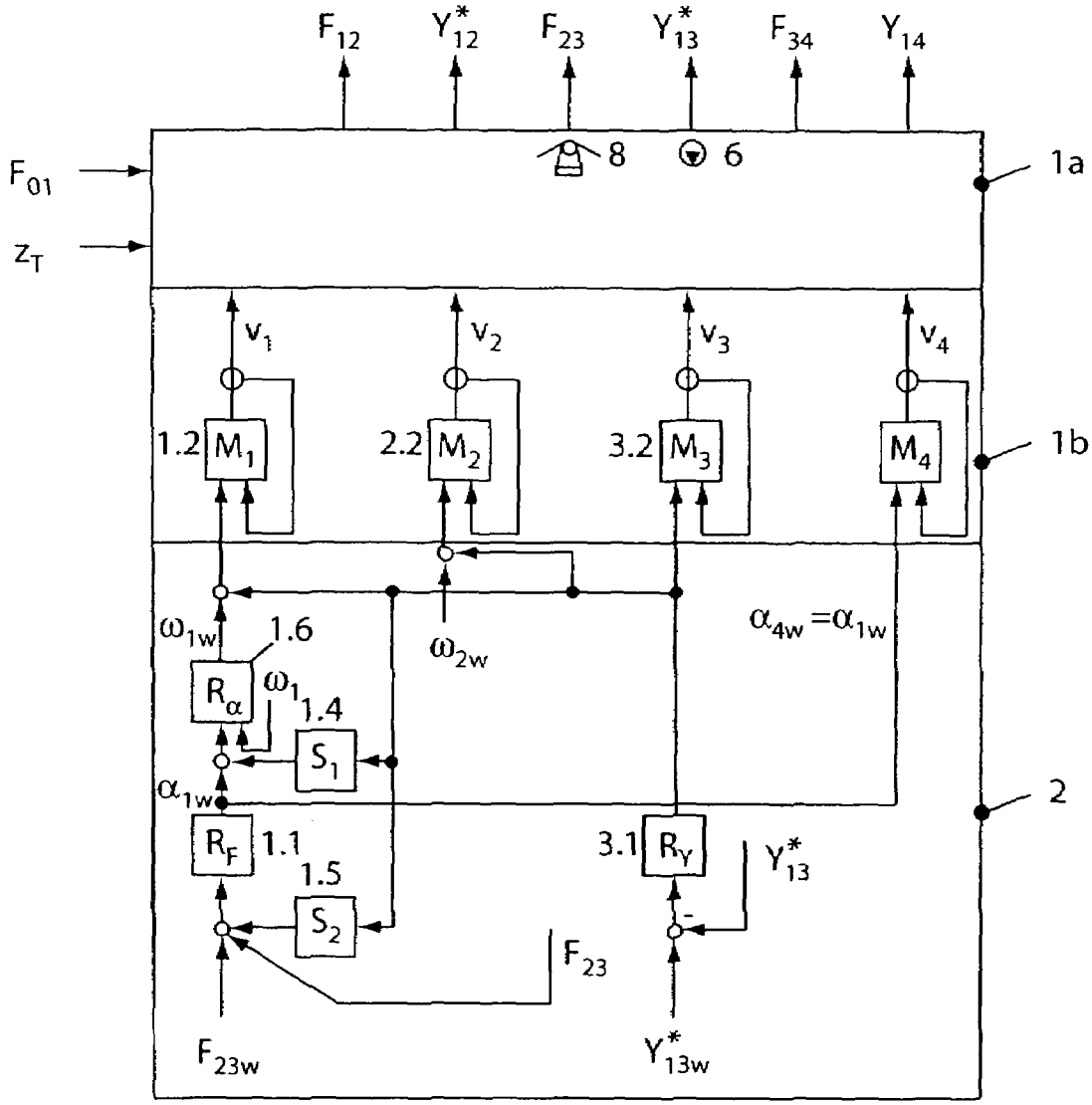
FIG. 5 is a schematic diagram showing partial decoupling of the controlled variables at the electronic level by balancing filters.

The four signal additions and subtractions described in FIG. 3 have been shown on the mechanical side of the system. In the actual system, these functions must be implemented within the control systems, that is to say at the electronic level, since they cannot be introduced into the mechanism 6.1 Decoupling Method I The addition of $v_3$ to $v_2$ is carried out in the form of an additional angular velocity set point at the input of the rotational speed control loop 2.2 as shown in FIG. 4. In one embodiment of the present invention, the addition of $v_3$ to $v_1$ is implemented in the form of an additional set point at the input of the tension controller 1.1. For this purpose, the transfer function 1.3 of the reciprocal closed tension control loop is needed. In an alternative embodiment, the addition may also be added to the set point $\omega_{1w}$ as shown in FIG. 5. In this case, two balancing filters 1.4 and 1.5, must be provided, which prevent the angle controller 1.6 and the tension controller 1.1 reacting in a compensatory manner to this feedforward control signal (the balancing filters are described in Brandenburg, G., Papiernik, W.: Feedforward and feedback strategies applying the principle of input balancing for minimal errors in CNC machine tools. Proc. 4th Workshop on Advanced Motion Control, AMC '96-MIE, Vol. 2, pp. 612–618). The feedforward control signal is not interpreted as a disturbance, on account of this measure.

6.2 Decoupling Method II

Figure 6:
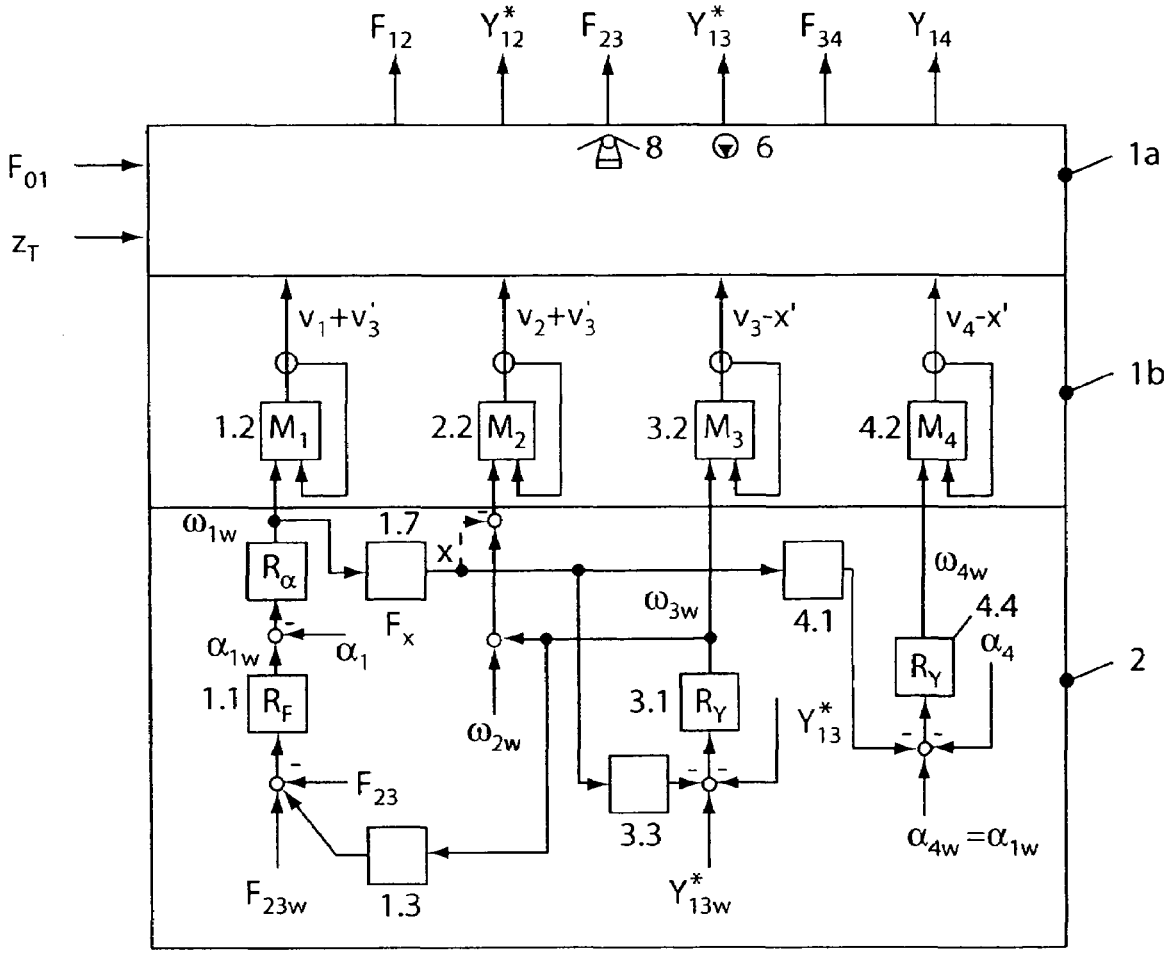
FIG. 6 is a schematic diagram showing complete decoupling of the controlled variables at the electronic level using additional set points for web tension and register error.
Figure 7:
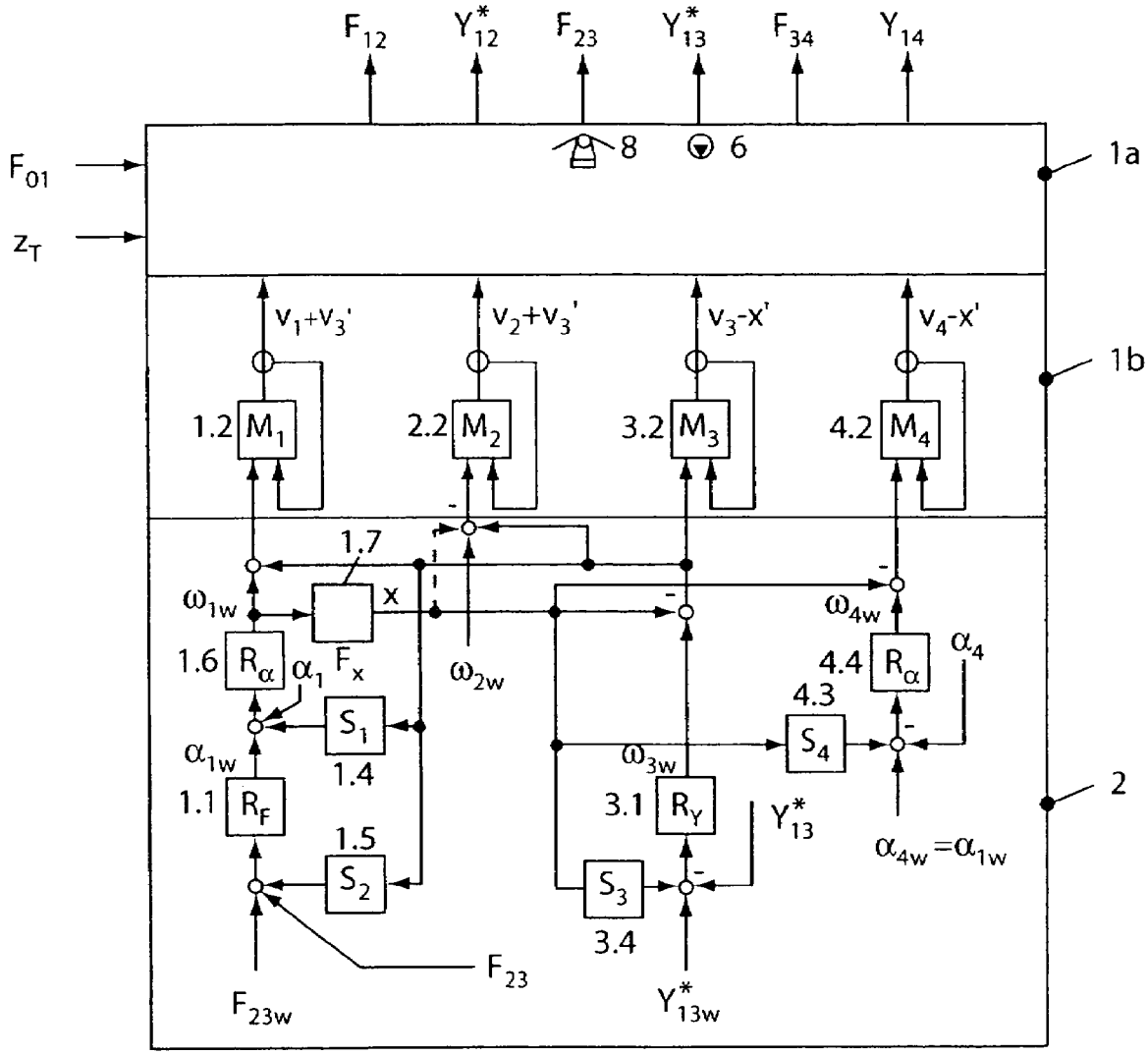
FIG. 7 is a schematic diagram showing complete decoupling of the controlled variables at the electronic level using balancing filters.

FIG. 6 shows that the output signal x from the transfer function $F_x$ 1.7 is implemented in the embodiment of FIG. 4 as an additional set point at the input of the register controller 3.1. For this purpose, the transfer function 3.3 is needed. The output signal x from the transfer function $F_x$ is additionally subtracted from the angle set point $\alpha_{4w}$ by the adaptation block 4.1. FIG. 7 shows the implementation of the transfer function $F_x$ 1.7 in the embodiment of FIG. 5. In this embodiment, the output signal x from the transfer function $F_x$ 1.7 is connected to the inputs of blocks 3.2 and 4.2. In this case, the balancing filters 3.4 and 4.3 are needed.

7. Interchanging the Manipulated Variables

Figure 8:
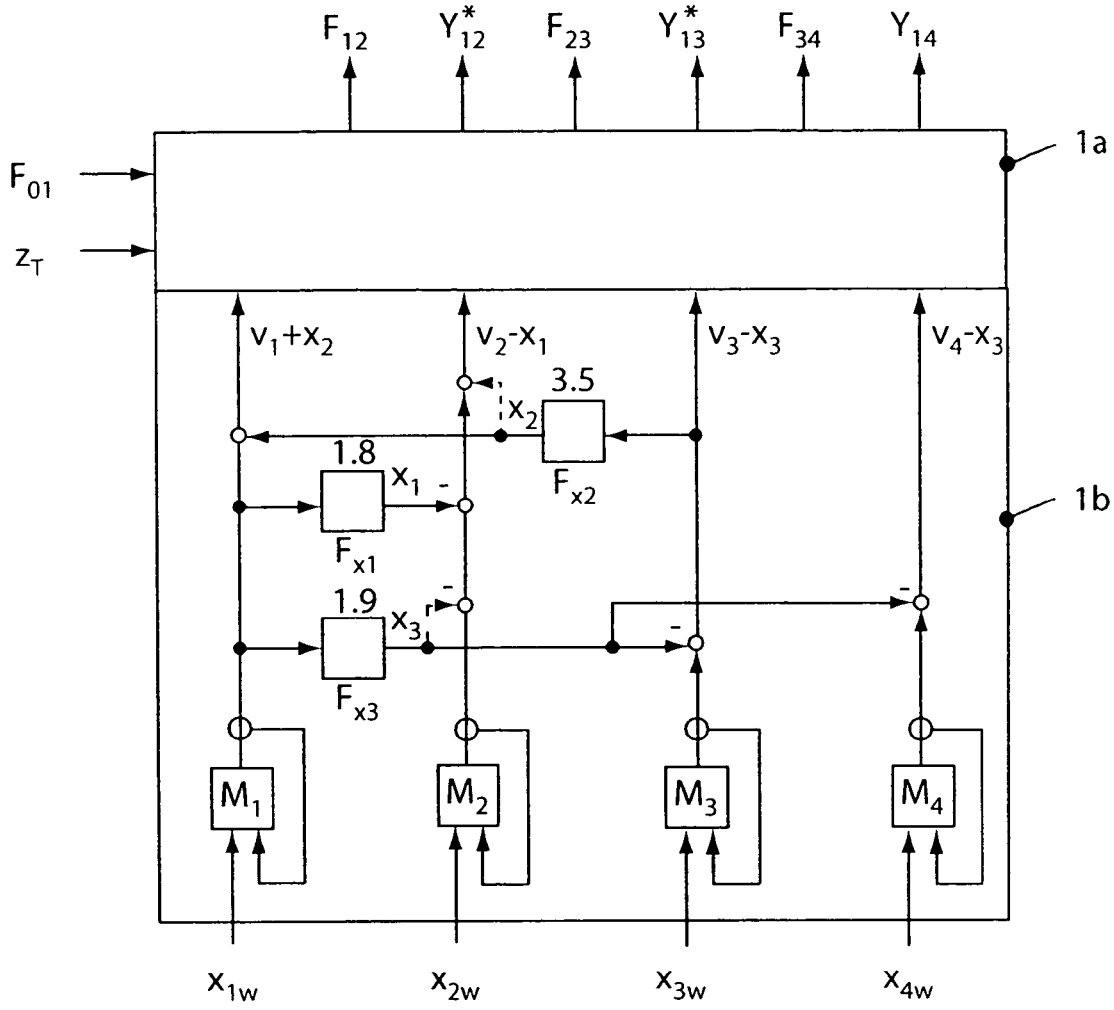
FIG. 8 is a schematic diagram showing complete decoupling of the controlled variables at the mechanical level.

In the control system described above, the tension $F_{23}$ was controlled by the lead or speed $v_1$ of the clamping point 1 ($K_1$) and the partial cutting register error $Y_{13}$* was regulated by the speed $v_3$ of the clamping point 3 ($K_3$). This may alternatively be effected in a mirror-image interchanged manner in which the tension $F_{23}$ is controlled by the speed $v_3$ of the clamping point 3 ($K_3$) and the register error is controlled by the lead or the angle of clamping point 1 ($K_1$). FIG. 8 shows how partial decoupling would be implemented. The transfer functions $F_{x1}$ and $F_{x2}$ can be calculated, the result being an integral element 1.8 for the transfer function $F_{x1}$ and a DT1 element (differential delay element of first order) 3.5 for the transfer function $F_{x2}$. An open integrator 1.8 often causes difficulties because the integration time constant can often be calculated only approximately, because of the insufficiently accurately known system data. In this situation, the control systems become unstable. The integrator 1.8 is therefore replaced by a PT1 element (proportional delay element of first order):

$$\frac{1}{T_1 s} \approx \frac{1}{1+T_1 s}$$

In this equation, $T_1$ is the integration time constant. Because of overswings in the measured signals, the DT1 element in the transfer function $F_{x2}$ may be non-beneficial. Therefore, this control variant is valuable only in special cases. The forward decoupling may be effected using block 1.9 in a similar way to that in FIG. 3, which results in complete decoupling.

The above-described two-variable control system may alternatively also be decoupled in accordance with the method of complete series decoupling, as it is known, for example, from Föllinger, O.: Regelungstechnik [Control engineering], Heidelberg: Hüthig-Verlag 1988. In this case, two decoupling methods, as illustrated above, are also possible, and the decoupling results in a similar manner.

8. Variants

Suitable manipulated variables for controlling the web tension in one web section are both the clamping point 1 (printing units) and the web tension $F_{01}$, both because of their characteristic of changing a non-steady and steady mass flow introduced into the system by changing the circumferential speed of the unwind directly or via further devices connected upstream in order to set the web tension.

If the force $F_{01}$ is used to control the web tension, the pressing force of the dancer roll or self-aligning roll, for example, is selected as manipulated variable for the web tension $F_{i-1,i}$ in the desired section i−1, i. The pressing force 2$F_{01}$ of the dancer roll may be readjusted, for example by the pressure in the associated pneumatic cylinder—not specifically illustrated here—via an appropriate pressure control loop. The dancer or self-aligning roll system must be equipped with communications interfaces for the necessary data interchange.

In the case of the clamping point 1 (i.e., the printing units), the speed $v_1$ of the printing units is changed, this change also being communicated to the position set point of the knife cylinder ($K_4$) and possibly further clamping points.

9. Self-Compensation of a Force

If the speed of one of the adjacent clamping points i or i, i+1 ($K_i$ or $K_{i,i+1}$) is selected for the control of a force $F_{i,i+1}$, then the characteristic of what is known as self-compensation of the force $F_{i,i+1}$ must be noted. In the event of a change in $v_{i+1}$, the force $F_{i,i+1}$ changes permanently, that it is to say can be controlled completely by $v_{i+1}$. In the case of a change in $v_i$, however, the force $F_{i,i+1}$ changes only temporarily in the case of purely elastic web material (Hookean material), that is to say non-permanently. The force $F_{i,i+1}$ cannot therefore be controlled completely by $v_1$. In order nevertheless to be able to use $v_i$ as a manipulated variable, such a self-compensation characteristic must not be present. If ink and/or moisture is put in during the printing operation and/or if heat is put in, for example by a dryer, in one of the sections upstream of the clamping point i ($K_i$), the self-compensation characteristic is lost, and $F_{i,i+1}$ also changes permanently. In this case, $v_i$ can also be used as a manipulated variable in a tension control loop.

In the illustrative example of an illustration press, if a dryer T is connected upstream of the clamping point 2 ($K_2$), the speed $v_2$ can be used as a manipulated variable for the force $F_{i-1,i}$, in a tension control loop (controller 2.1), the latter being superimposed on the drive controller 2.2. The tension control loop then operates in a decoupled form together, for example, with a register control loop (controller i.3) for $Y_{1i}$*. Alternatively, for example the force $F_{23}$ could be controlled.

As a result of choosing a speed $v_i$ as manipulated variable for the control of the web tension $F_{i-1,i}$, this force is changed permanently and all the following web tensions only temporarily if $F_{i,i+1}$ is self-compensating. As a result of choosing a speed $v_{i-1}$ as manipulated variable for the control of the web tension $F_{i-1,i}$, this and all the following forces are changed permanently if, as described above, $F_{i-1,i}$ is not self-compensating.

It should be noted that it would be possible to change the force $F_{i-1,i}$ permanently by the force $F_{i-2,i-1}$ being changed with the speed $v_{i-1}$ and $v_i$ being carried along with it, so that $v_i=v_{i-1}$ would be the case. However, $v_i$ would then no longer be available as an independent manipulated variable for $Y_{1i}$*. The availability of two independent manipulated variables is, however, critical for the decoupled predefinition of the two controlled variables, that is to say $F_{i-1,i}$ and $Y_{1i}$*.

Instead of the clamping point 1 (i.e., the printing units), another clamping point may alternatively be selected as manipulated variable of the web tension.

A first possibility is to choose the pressing force of the dancer roll as a manipulated variable for the web tension in the desired section, for example the web tension $F_{23}$ in the desired section 2–3. In this case, the pressing force $2F_{01}$ (FIG. 1*a*) of the dancer roll—not specifically illustrated—is readjusted, for example via the pressure in the associated pneumatic cylinder, via an appropriate pressure control loop. The dancer roll system must also be equipped with communications interfaces for the necessary data interchange. Instead of the dancer roll, there may also be a web tension control loop.

The second possibility is to use the speed of a clamping point, which must satisfy specific preconditions, as are explained in the following text. In the event of a change in the speed $v_i$ of a clamping point i ($K_i$) which lies between two clamping points $K_{i-1}$ and $K_{i+1}$ whose speeds $v_{i-1}$ and $v_{i+1}$ are constant, the force $F_{i-1,i}$ changes permanently. However, the force $F_{i,i+1}$ changes only temporarily, that is to say not permanently. This characteristic is designated self-compensation of the force $F_{i,i+1}$ and is present in the case of purely elastic web material. Under these conditions, the force $F_{i,i+1}$ cannot be controlled completely. If ink and/or moisture is put in during the printing operation and/or if heat is put in, for example by means of a dryer, located upstream of the clamping point i ($K_i$), the self-compensation characteristic is lost, and $F_{i,i+1}$ also changes permanently. Under this assumption, the speed $v_i$ of the clamping point i ($K_i$) can be used as manipulated variable for setting a web tension. If, for example according to FIG. 1*a*, in the case of an illustration press, a dryer is connected upstream of the clamping point 2 ($K_2$), then $F_{23}$ may be controlled by a tension control loop using the speed $v_2$ and then, as described above, operates in decoupled form together with the register control loop for $Y_{13}$*.

Controlling the Register Error on the Knife Cylinder

Figure 9:
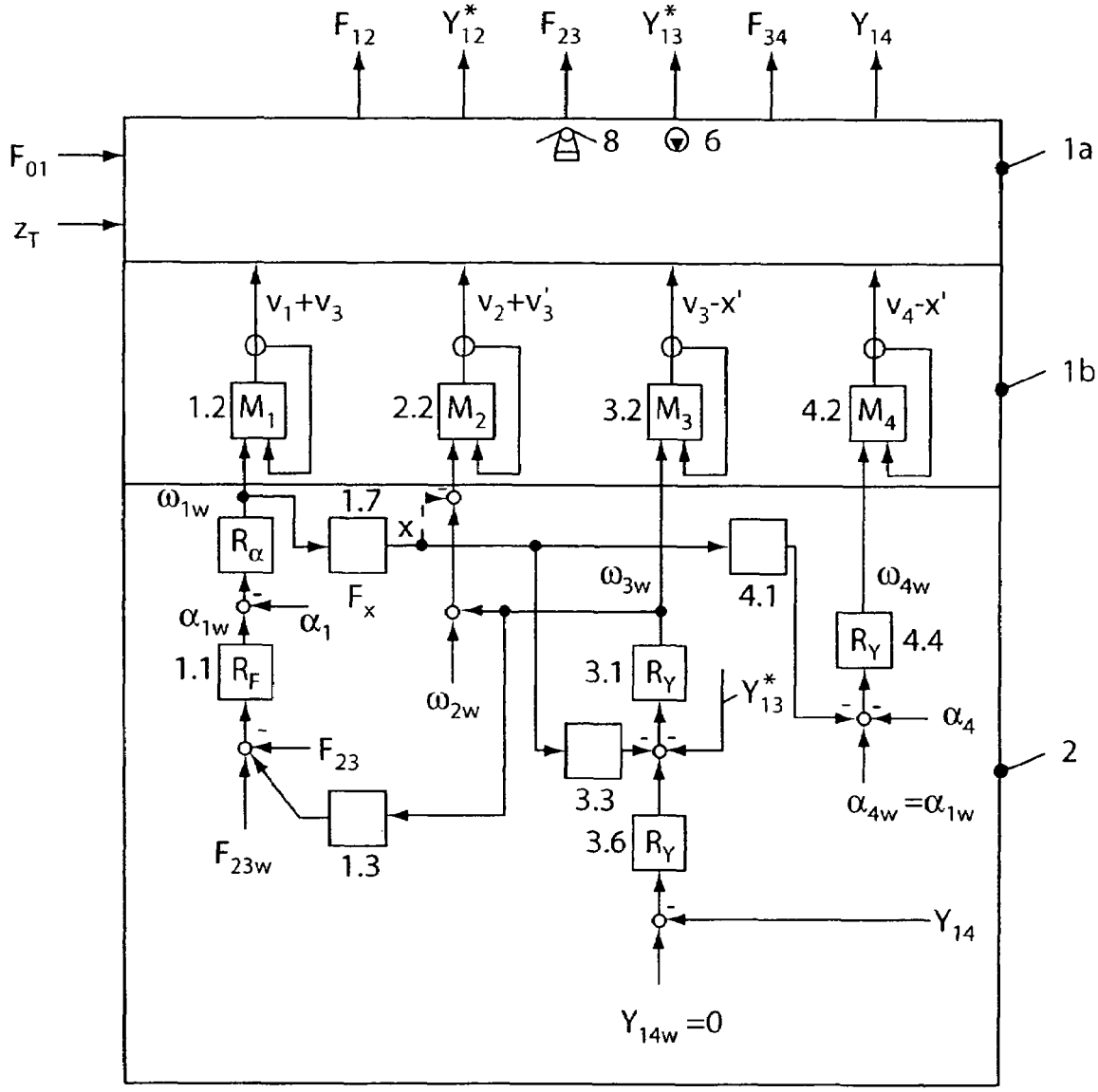
FIG. 9 is a schematic diagram showing control of the cutting register error with subordinate, completely decoupled control loops.

The combined cutting register/web tension control of a web-fed rotary press according to the above description, as illustrated in FIG. 6, for example, is capable of controlling the partial register error $Y_{13}$* in accordance with the predefined set point $Y_{13w}$*, for example $Y_{13w}$*=0 and, and decoupled from this, the web tension $F_{23}$ in accordance with the set point $F_{23w}$ dynamically and quickly. All the incoming disturbances, for example caused by a reel change, are consequently already detected far before the knife cylinder and may be controlled out at the location of detection. The error at the location of the cut is certainly kept small as a result but, in the further course of the web, normally in the form of a plurality of part webs, as far as the location of the cut, further sources of disturbance occur which cause a cutting register error. Therefore, the cutting register error, designated $Y_{14}$ in the illustrated four-roll system example, is measured by a further sensor 5 immediately before the knife cylinder $K_4$ and is supplied to a further register controller 3.6, as FIG. 9 shows using the FIG. 6 embodiment of complete decoupling. This further register controller 36 then supplies the set point $Y_{13w}$* which will generally change as result of the predefinition $Y_{14w}$. The control loop for $Y_{13}$*, which is now subordinate, ensures that the controller 4.4 for $Y_{14}$ substantially only has to control out the disturbances which occur after the clamping point 3. The higher-order register control loop is capable of operating together with all the control variants described above.

The case of multi-web operation is described in the parallel Patent Application DE 103 35 886.

In the parallel Patent Application DE 103 35 888 (U.S. patent application Ser. No. 10/913,247), the control of the partial cutting register error by the lead of a non-printing clamping point is disclosed. Furthermore, in this parallel Patent Application DE 103 35 888, the connection of the total register error measured on the knife cylinder to the control loop for this partial cutting register error is disclosed. In addition, controlling the position or speed of a knife cylinder in order to correct the total register error is disclosed in DE 103 35 888.

Instead of the tension control using the printing units, as described in the section "Controlling the register error at a non-printing clamping point before the knife cylinder" under item 3, Tension control loop, the angular velocity of the cooling unit may be used, as described below.

Tension Control Loop

Because the register control via the lead of the clamping point 3 ($K_3$) is associated with a change in the web tension $F_{23}$, it is not possible to rule out the situation where large disturbances cause excessively small or excessively large web tensions, which can lead to a web break. The web tension $F_{23}$ must therefore be limited. For this purpose, web tension $F_{23}$ is measured using a tension sensor 8 such as, for example, a measuring roll. The measured web tension $F_{23}$ is supplied to the comparison point of a tension controller 2.1 and compared with the set point $F_{23w}$ (see FIG. 10). The tension controller 2.1 ensures compliance with the desired web tension $F_{23}$ and, at the same time, enables it to be predefined in a paper grade-dependent manner by the machine operator, who no longer has to intervene in setting the lead of the clamping point 3 ($K_3$). The tension controller

2.1 predefines the angular velocity set point $\omega_{2w}$, that is to say the lead of the cooling unit.

The use of the lead of the cooling unit as manipulated variable for the force $F_{23}$ is possible because when the angular velocity $\omega_2$ is adjusted, the force $F_{23}$ is not self-compensating. This can be attributed to the change in the paper properties as a result of the input of moisture and humidity by the printing units of clamping point 1 and the drying section T (see, e.g., FIG. 1*a*).

Couplings Between the Controlled Variables

Figure 10:
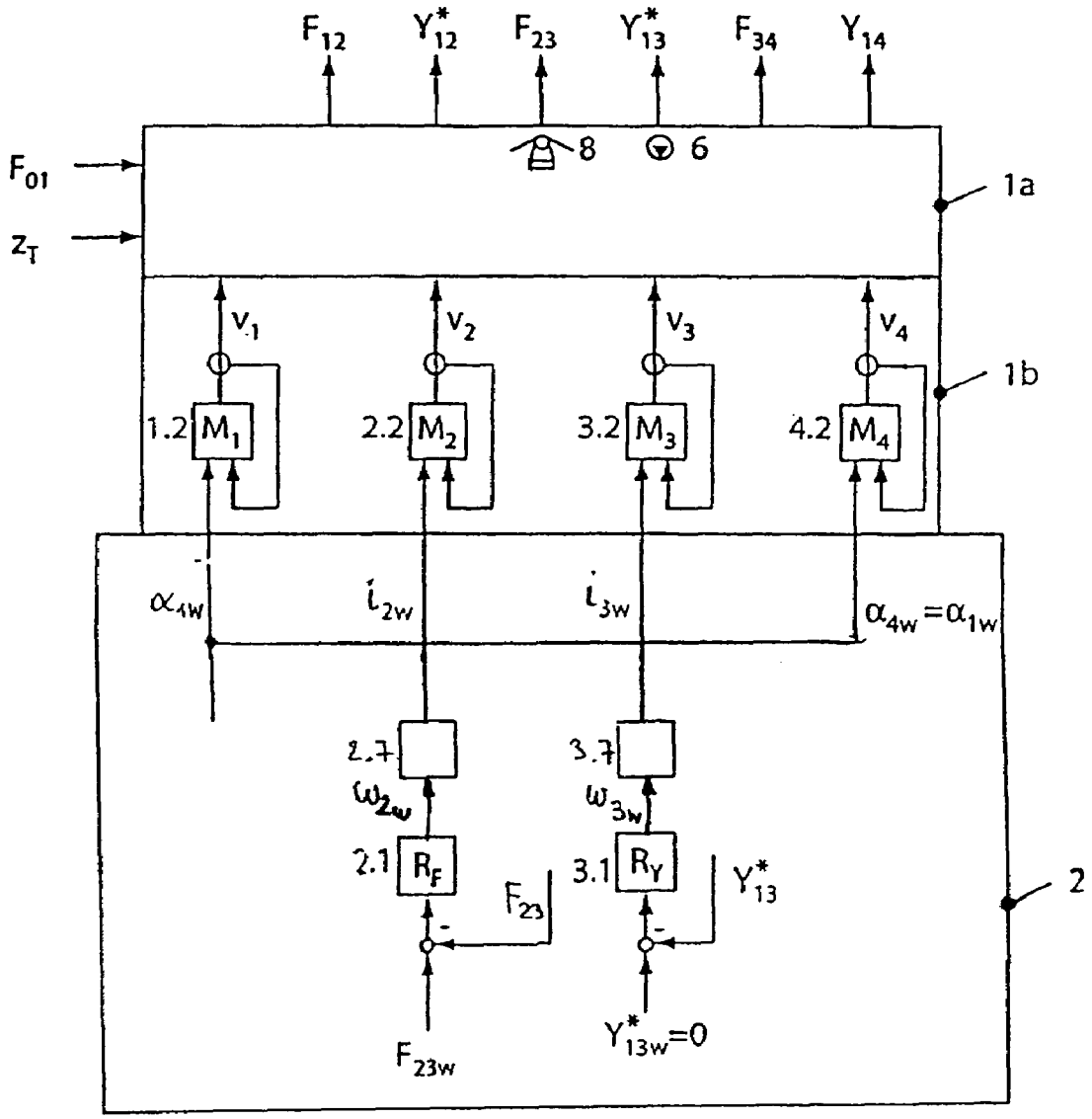
FIG. 10 is a schematic diagram of an arrangement for controlling the cutting register error using the lead of a clamping point and controlling the web tension using the lead of a cooling unit.

The two controlled variables in FIG. 10, namely the partial cutting register error $Y_{13}$* and the tension $F_{23}$, depend on each other, that is to say they are coupled to each other, by the structure of the control system. If, for example, a set point change $F_{23w}$ is made, then the action of the tension controller 2.1 causes a partial cutting register error $Y_{13}$*. The register control loop (controller 3.1) now attempts to lead this error $Y_{13}$* back to the set point $Y_{13,w}$*, for example value 0, by a change in speed $v_3$. This produces a further change in the force $F_{23}$ and thus the tension control loop responds again, and so on. Accordingly, the entire system can therefore become unstable.

Decoupling

Figure 11:
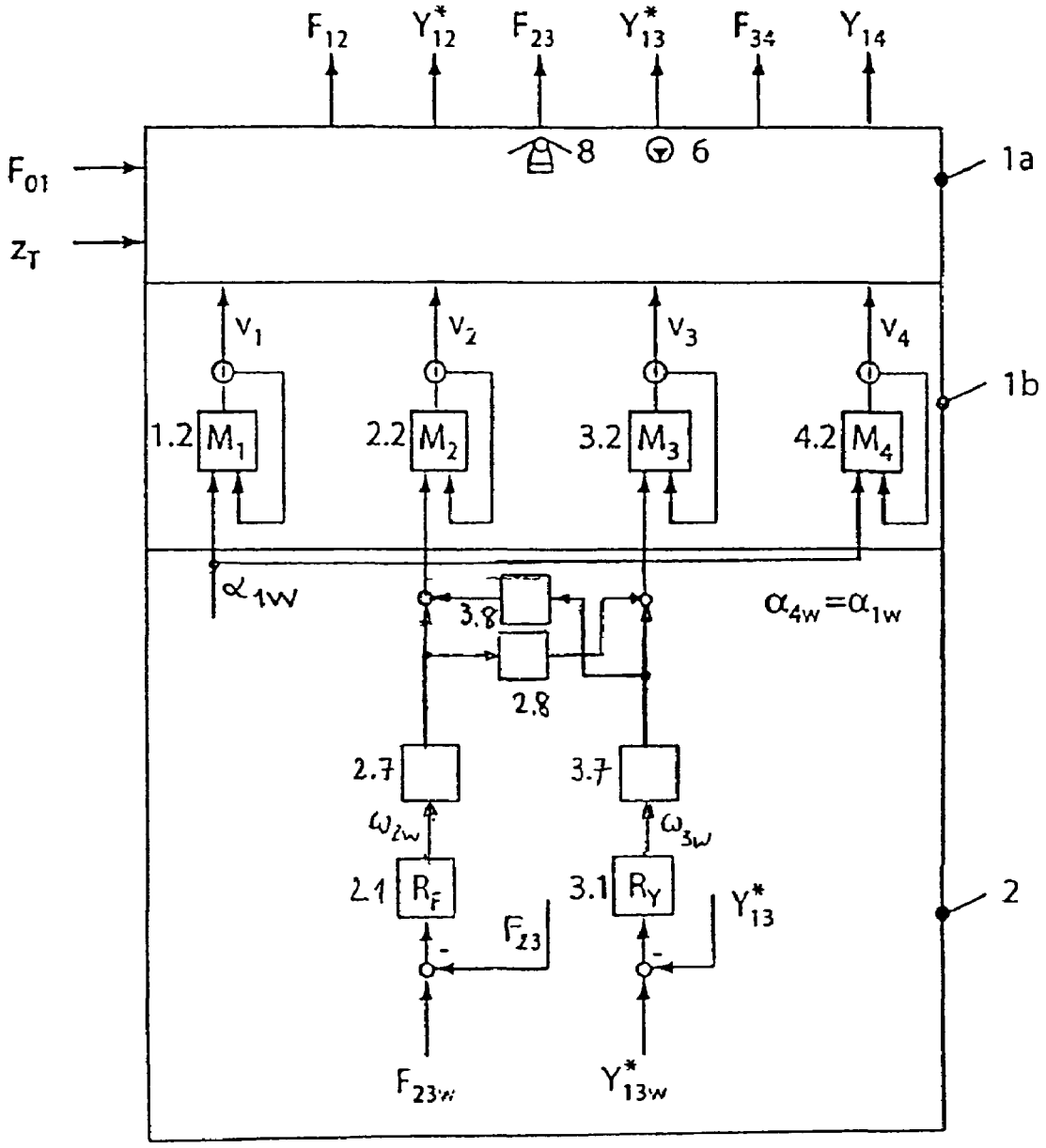
FIG. 11 is a schematic diagram showing complete decoupling of the controlled variables at the mechanical level according to the arrangement in FIG. 10.
Figure 12:
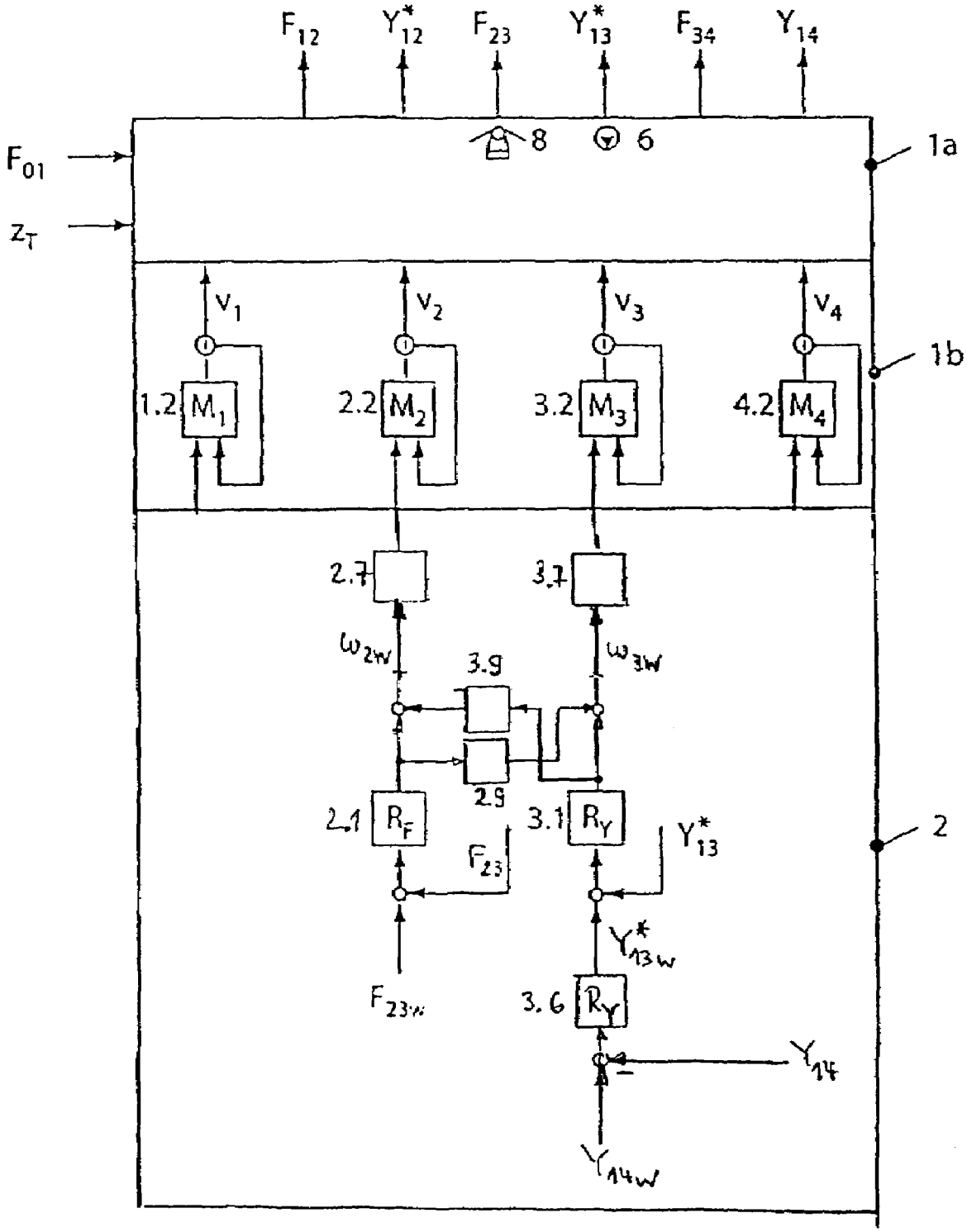
FIG. 12 is a schematic diagram showing complete decoupling of the controlled variables at the electronic level according to the arrangement of FIG. 11.

Because of the change in paper properties caused by the exposure of the paper web to moisture and heat, a change in the angular velocity $\omega_2$ causes a change in the web tension $F_{12}$ that is so small that its effect on the web sections following in the transport direction is negligible. Using this approximation, simple decoupling algorithms may be derived. Decoupling at the mechanical level characterized by the block 2.8 in the forward direction and in the block 3.8 in the reverse direction, is illustrated in FIG. 11. The blocks 2.7 and 3.7 represent the equivalent transfer functions of the closed rotational speed control loops of the clamping points 2 ($K_2$) and 3 ($K_3$). Since such decoupling is not possible at the mechanical level, this is carried out at the level of the electronic drive controllers, as indicated in FIG. 12 by the blocks 2.9 and 3.9. The objective is to make the partial cutting register error $Y_{13}$* dependent solely on the speed $v_3$ and web tension $F_{23}$ dependent solely on speed $v_1$.

The tension controller 2.1 and the register controller 3.1, for example, comprise PI controllers. This then ensures that both control loops operate dynamically largely uninfluenced by each other and the predefined set points for the force $F_{23}$ and the partial cutting register error $Y_{13}$* are assumed without steady-state errors.

The above-described measures for the cutting register control are not intended to relate just to the application in web-fed offset rotary presses, but can be applied in all other printing processes, printing materials and presses in an equivalent way, in particular in gravure printing, screen printing, flexographic printing, textile printing, film printing, metal printing, label printing machines, textile printing machines, film printing machines, illustration and newspaper presses and so on.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a cutting register error in a rotary press including a plurality of clamping points through which a web is drawn, comprising the steps of:

registering, by a first sensor, a cutting register by sensing one of a specific item of image information and measuring marks on the web running through the rotary press;

supplying a first register signal from the first sensor to a control device, the first register signal being generated by the first sensor in response to the cutting register;

registering, by a second sensor, a web tension of the printed web by sensing the web tension;

supplying a second register signal from the second sensor to the control device, the second register signal being generated by the second sensor in response to the web tension;

determining, by the control device, one of a partial cutting register error and a total cutting register error from the first register signal, the one of a partial and total cutting register error representing a deviation of the cutting register from its intended position at the time of registering; and influencing, by the control device, the one of the partial and total cutting register error and the web tension, wherein the influencing of the cutting register error is decoupled from the influencing of the web tension.

2. The method of claim 1, wherein said step of influencing comprises manipulating a lead of a non-printing clamping point of said plural clamping points for influencing the one of the partial and total cutting register error and manipulating a lead or position of a printing unit clamping point of the plural clamping points for influencing the web tension, each of said steps of manipulating comprises using appropriate control loops to which normal drive controls for one of current, rotational speed and angle control are subordinated.

3. The method of claim 1, wherein said step of influencing comprises manipulating a circumferential speed of an unwind device which determines the steady and unsteady mass flow introduced into the rotary press.

4. The method of claim 3, wherein the circumferential speed is influenced in response to at least one measured value for web tension, web stress or web extension, by a position of a dancer or self-aligning roll acting on the web with a force, or by a web tension control loop controlling the force.

5. The method of claim 1, wherein one of the clamping points includes a knife cylinder, said step of registering the cutting register comprises registering the cutting register at or before a first clamping point of the plural clamping points, said step of registering a web tension comprises registering the web tension at or before one of the first clamping point and a second clamping point of the plural clamping points, the first and second clamping points being non-printing clamping points and arranged upstream of the knife cylinder such that the one of the partial and total cutting register error comprises a partial cutting register error, and said step of influencing comprises influencing the partial cutting register error and the web tension to desired set points by manipulating manipulated variables using associated controllers.

6. The method of claim 5, wherein the cutting register is registered in a first web section and the web tension is registered in a second web section upstream of the first web section, the manipulated variable for the partial cutting register error is a speed of one of the plural clamping points, and the manipulated variable for the web tension in a web section is the speed of another of the plural clamping points located upstream of the one of the plural clamping points.

7. The method of claim 6, wherein the association between controlled variables, including the cutting register error and the web tension, and the manipulated variables is interchanged.

8. The method of claim 5, wherein the cutting register and web tension are registered in the same web section, the manipulated variable for the partial cutting register error is a speed of one of the plural clamping points, the manipulated variable for the web tension is a speed of another of the plural clamping points located upstream of the input to the same web section, and the web tension is not self-compensating.

9. The method of claim 8, wherein the association between controlled variables, including the cutting register error and the web tension, and the manipulated variables is interchanged.

10. The method of claim 5, wherein the cutting register and web tension are registered in the same web section, the manipulated variable for the partial cutting register error is a speed of one of the plural clamping points, the manipulated variable for the web tension is a speed of another of the plural clamping points arranged at an input to the same web section, and the web tension is not self-compensating.

11. The method of claim 10, wherein the association between controlled variables, including the cutting register error and the web tension, and the manipulated variables is interchanged.

12. The method of claim 5, wherein the cutting register is registered in a first web section and the web tension is registered in a second web section downstream of the first web section, the manipulated variable for the partial cutting register error is the speed of one of the plural clamping points arranged at the output of the first web section, and the manipulated variable for the web tension is the speed of another one of the plural clamping points arranged at or before an input of the second web section, said another one of the plural clamping points being arranged downstream of the one of the plural clamping points.

13. The method of claim 12, wherein the association between controlled variables, including the cutting register error and the web tension, and the manipulated variables is interchanged.

14. The method of claim 5, wherein the manipulated variable for controlling the partial cutting register error comprises a current, speed, or angle of one of the plural clamping points, said method further comprising performing at least one of reverse decoupling in which additional decoupling set points are received by at least one clamping point located before the one of the plural clamping points controlling the partial cutting register error, and forward decoupling in which at least one clamping point located after the one of the plural clamping points controlling the partial cutting register error receives an additional decoupling lead set point.

15. The method of claim 14, wherein the step of performing reverse decoupling comprises performing partial decoupling in the reverse direction including predefining a first additional decoupling lead set point for a first clamping point prior to the one of the plural clamping points, the first additional decoupling lead set point comprising an additional rotational speed set point, and predefining a second additional decoupling set point for a second clamping point prior to the one of the plural clamping points, the second additional decoupling set point comprising a corresponding additional tension set point at the input of the tension controller using an appropriately modified transfer function of a closed tension control loop.

16. The method of claim 14, wherein the step of reverse decoupling comprises predefining a first additional decoupling lead set point for a first clamping point prior to the one of the plural clamping points, the first additional decoupling lead set point comprising an additional rotational speed set point, and applying the first additional decoupling lead set point using balancing filters.

17. The method of claim 14, further comprising performing forward decoupling using an output signal of a transfer function based on the manipulated variable of the one of the plural clamping points as the additional decoupling set point at the input of a register controller using a further transfer function.

18. The method of claim 14, further comprising performing forward decoupling using an output signal of a transfer function based on the manipulated variable of the one of the plural clamping points as the additional decoupling set point at the input of a register controller by using a balancing filter on a subordinate rotational speed control loop of the register control loop for the at least one clamping point located after the one of the plural clamping points.

19. The method of claim 18, wherein the step of forward decoupling further comprises tracking the speed of a further clamping point arranged after the one of the plural clamping points to the speed of one of the plural clamping points, the output signal of the transfer function being supplied to an angle controller of the further clamping point as an additional angle set point using a second transfer function.

20. The method of claim 18, wherein the step of forward decoupling further comprises tracking the speed of a further clamping point arranged after the one of the plural clamping points to the speed of one of the plural clamping points, the output signal being supplied using a balancing filter as an additional rotational speed set point on the subordinate rotational speed control loop of the further clamping point.

21. The method of claim 1, wherein one of the clamping points includes a knife cylinder, and said step of registering the cutting register is performed immediately before the knife cylinder, said step of influencing the one of the partial and total cutting register error includes using a register controller which is superimposed on a register controller of a clamping point upstream of the knife cylinder.

22. The method of claim 1, wherein said step of influencing comprises allowing the web tension to assume a tension set point which lies in a prescribed range, and correcting the cutting register error to a register set point.

23. A method for controlling the cut register error of a rotary press including a plurality of clamping points through which a web is drawn, comprising the steps of:

setting controlled variables so that the controlled variables assume corresponding setpoints, by manipulating a manipulated variable including at least one of a speed and an angular position of one of the plural clamping points for each of controlled variables by a controller using a control loop, the setting of each of the controlled variables being decoupled from the setting of the others of the controlled variables, said controlled variables comprising at least one web tension, at least one partial cutting register error and the total cutting register error.

24. The method of claim 23, further comprising the step of registering the at least one partial cutting register error and the total cut register error using first sensors which evaluate one of a specific item of image information and measuring marks of the printed web, and registering the at least one web tensions using a second sensor, said first and second sensors generating signals and supplying the signals to a control device.

25. The method of claim 23, wherein the manipulated variable for a partial cutting register error in a first web section is a lead of a non-printing clamping point comprising a turner unit and the manipulated variable for a web tension in the first web section or a second web section upstream of the first web section is the lead of another clamping unit comprising a cooling unit upstream of the turner unit, the controller for the manipulated variables being implemented by control loops, wherein normal drive controllers for the turner unit and cooling unit are subordinated to the controllers for the manipulated variables.

26. The method of claim 25, wherein the association between controlled variables and manipulated variables, including all the decoupling and feedforward control measures needed for this configuration, is interchanged.

27. The method of claim 23, further comprising the step of decoupling the setting of the control variables using transfer functions, the transfer functions being calculated analytically in accordance with a mathematical model of the press.

28. The method of claim 27, further comprising the step of deriving a decoupling algorithm using the plastic deformation of the paper web during a change in the lead of one of the clamping units comprising a cooling unit.

29. The method of claim 28, further comprising implementing decoupling algorithms calculated for a mechanical level at an electronic level of controlled electric drives.

30. The method of claim 27, wherein the transfer functions are based on decoupling algorithms in which open integrators with an integration time constant are replaced by delay elements of first order with the time constant.

31. The method of claim 23, wherein the controllers are part of an interconnected control system for controlling the controlled variables to the associated setpoints, the control system comprising decoupling algorithms and algorithms for the controllers.

32. The method of claim 23, further comprising the step of limiting, by a control loop for the web tension, an angular velocity set point such that the force upstream of the clamping point controlling the one of the partial and total cutting register error is kept within prescribed limits.

33. The method of claim 23, further comprising the step of limiting, by a control loop for one of the partial cutting register error and the total cutting register error, an angular velocity set point such that the lead of the clamping point controlling the one of the partial cutting register error and the total cutting register error is kept within prescribed limits.

34. The method of claim 23, further comprising the steps of registering the total cutting register error immediately before the knife cylinder and controlling the total cutting register error by a register controller superimposed on a register controller of the clamping point which is arranged immediately upstream of the knife cylinder.

35. In a rotary press comprising a plurality of clamping points through which a web is fed, said clamping points including an unwind for introducing a mass flow of the web into the rotary press and a knife cylinder for cutting the web, each of the plural clamping points being independently driven by drive motors with at least one of current, rotational speed, and angle control, an apparatus for controlling a cutting register error of the web, comprising:

at least one first sensor arranged one of upstream and at the knife cylinder for registering a cutting register on the web, each of said at least one first sensor outputting a first signal in response to the cutting register, wherein said cutting register comprises a specific item of image information or a measuring mark on the web;

a second sensor arranged for registering a web tension and generating a second signal;

a control device connected to said at least one first sensor and second sensor for receiving the first and second signals and arranged for determining at least one of a partial cutting register error and a total cutting register error in response to the first signal received from said at least one first sensor and a web tension in response to the second signal received from the second sensor, the total cutting register error representing a deviation of the cutting register from its intended position at the time that the cutting register is registered at the knife cylinder by said at least one first sensor with respect to when the cutting register was one of registered at a previous clamping point and printed at a printing clamping point, and the partial cutting register error representing a deviation of the cutting register from its intended position at the time that the cutting register is registered at a clamping point prior to the knife cylinder by said at least one first sensor with respect to when the cutting register was one of registered at a previous clamping point and printed at a printing clamping point; and a man-machine interface connected to said controller for allowing setpoints for a web tension to be set separately from a set point of a partial cutting register error and a total cutting register error such that the control of the web tension is decoupled from control of the partial cutting register error.

36. The apparatus of claim 35, further comprising an unwind device controllable by one of dancer rolls and web tension control loops for changing the unsteady and steady mass flow introduced into the rotary press in response to one of a circumferential speed of one of the plural clamping points and a web tension at one of the plural clamping points.

37. The apparatus of claim 35, wherein each of said first and second sensors comprises a communication interface connected for transmitting the register signal, said communication interface communicating with one of a field bus, Ethernet, another communication bus, and another communication interface.

38. The apparatus of claim 35, wherein said controller is operatively arranged for processing the register signal in real time, said controller comprising one of a central computer, an embedded computer, and a decentralized device.

* * * * *